US009016038B2

(12) United States Patent
Stowe et al.

(10) Patent No.: US 9,016,038 B2
(45) Date of Patent: Apr. 28, 2015

(54) FID APPARATUS AND METHOD OF USING

(71) Applicant: Lutco, Inc., Worcester, MA (US)

(72) Inventors: John C. Stowe, Boylston, MA (US); Andrzej Zakrzewski, Worcester, MA (US)

(73) Assignee: Lutco, Inc., Worcester, MA (US)

( * ) Notice: Subject to any disclaimer, the term of this patent is extended or adjusted under 35 U.S.C. 154(b) by 0 days.

(21) Appl. No.: 14/189,524

(22) Filed: Feb. 25, 2014

(65) Prior Publication Data

US 2014/0260173 A1 Sep. 18, 2014

Related U.S. Application Data

(60) Provisional application No. 61/780,440, filed on Mar. 13, 2013.

(51) Int. Cl.
*B65H 69/06* (2006.01)
*D07B 7/18* (2006.01)

(52) U.S. Cl.
CPC . *B65H 69/06* (2013.01); *D07B 7/18* (2013.01)

(58) Field of Classification Search
CPC ..... D07B 1/18; B65H 69/06
USPC ..... 57/23
See application file for complete search history.

(56) References Cited

U.S. PATENT DOCUMENTS 508,745 A * 11/1893 Paul ..... 223/102
535,108 A * 3/1895 Helgesson ..... 57/23
563,155 A * 6/1896 Fulson et al. ..... 57/23
748,714 A * 1/1904 Fesenfeld ..... 57/23
759,717 A * 5/1904 Kappler ..... 57/23
961,201 A * 6/1910 Altheide ..... 57/23
1,293,453 A * 2/1919 Jacobson et al. ..... 57/23
1,542,656 A * 6/1925 Balod ..... 57/23
1,584,365 A * 5/1926 Fuller ..... 57/23
2,394,884 A 2/1946 Adrias et al.
2,423,673 A * 7/1947 Adrias ..... 57/23

(Continued)

FOREIGN PATENT DOCUMENTS

CN 2583144 10/2003
EP 0 156 992 10/1985

OTHER PUBLICATIONS

Video of "splicing double braid" posted by New England Ropes on Oct. 2, 2010 retrieved on May 17, 2014 <URL: https://www.youtube.com/watch?v=UghiS9xdiDw> entire video.

(Continued)

*Primary Examiner* — Shaun R Hurley
(74) *Attorney, Agent, or Firm* — Sean D. Detweiler, Esq.; Morse, Barnes-Brown & Pendleton, P.C.

(57) ABSTRACT

A fid apparatus includes a first channel formed along one side of the fid and a second channel formed along an opposite side of the fid. The fid further includes an aperture that passes completely through both the first channel and the second channel. This arrangement enables the fid to be able to grasp or clutch a segment of rope during a splicing process. The splicing process involves a method of using the fid apparatus in such a way that the segment of rope is arranged within the first channel, second channel, and aperture of the fid prior to commencing splicing processes. The segment of rope used is determined by the particular form of splicing that is implemented.

23 Claims, 4 Drawing Sheets

(56) References Cited

U.S. PATENT DOCUMENTS

| | | | | | |
|---|---|---|---|---|---|
| D149,901 | S | * | 6/1948 | Olsen | D8/14 |
| 2,503,507 | A | * | 4/1950 | Olsen | 57/23 |
| 2,739,439 | A | | 3/1956 | Elsner | |
| 2,884,755 | A | | 5/1959 | Malm | |
| 3,397,660 | A | | 8/1968 | Luther et al. | |
| 3,823,535 | A | * | 7/1974 | McGrew | 57/23 |
| 4,158,281 | A | * | 6/1979 | Morang | 57/23 |
| D283,974 | S | * | 5/1986 | McGrew | D8/14 |
| 4,974,488 | A | | 12/1990 | Spralja | |
| 5,152,130 | A | | 10/1992 | McGrew | |
| 6,360,519 | B1 | | 3/2002 | Hoover | |

OTHER PUBLICATIONS

International Search Report for international Application PCT/US2014/018325, dated Jun. 16, 2014.

Samson Splicing Instructions—Eye Splice Double Braid Class I. www.samsonrope.com Samson Rope Technologies, Inc. 1-4 (2007).

Samson Splicing Instructions—Double Braid Class I Eye Splice. www.samsonrope.com Samson Rope Technologies, Inc. 1-4 (2012).

* cited by examiner (Along A-A)

FID APPARATUS AND METHOD OF USING

RELATED APPLICATION

This application claims priority to, and the benefit of, U.S. Provisional Application No. 61/780,440 filed Mar. 13, 2013, for all subject matter common to both applications. The disclosure of said provisional application is hereby incorporated by reference in its entirety.

FIELD OF THE INVENTION

The present invention relates to a fid suitable for splicing rope, and more particularly to a fid having a first and second channel and an aperture disposed through the channels to receive the rope being spliced.

BACKGROUND OF THE INVENTION

Fids are used in many fields for splicing rope such as braided or covered rope. A fid is used to open up strands or portions of rope for splicing. In particular, the fid is used in holding rope open or can be used to allow a splicer to push strands through another section of rope as part of the splicing process.

Many fids are made from wood, bone, aluminum, steel, or plastic material. Conventional fids have a conical shape with a tapered end portion. A fid can be constructed to have a variety of diameters based on the size of the rope being spliced.

In one example, the fid is an aluminum bar with a tapered point front section on one end and a hollow back section at an opposite end with respect to the front section. The front section is used to open up strands of rope using the tapered point. Some of the strands of rope can be laid flat into the hollow back section of the fid so that the fid can be used to pull these strands through another section of rope. Some require a "pusher" to help retain a segment of rope, such as a core portion, and then push the fid through another segment of rope.

In addition to a fid being used in direct contact with the rope, some fids have markings along the fid's body that are used for measuring segments of rope at certain stages in the splicing process. In particular, a fid can be used as a measurement tool for determining points in the rope where actions need to be taken during the splicing process.

There has been a need for a fid capable of holding onto a segment of rope while the fid is threaded through another section of the rope. In one example, the segment of rope is taped onto a back end of the fid to keep it securely in place. Alternatively, fids having the hollow back section can provide a space for the segment of rope to be laid flat within during splicing. However, the hollow back section often requires further taping to secure the rope within the fid. Therefore, this issue has not been adequately addressed or solved.

SUMMARY

There is a need for a fid that provides an improved feature of clutching or grasping a segment of rope to be threaded through another segment of rope during the splicing process without requiring additional taping, pushing, or auxiliary fasteners, which would slow down the splicing process. The present invention is directed toward further solutions to address this need, in addition to having other desirable characteristics.

In accordance with an embodiment of the present invention, a fid for splicing has an elongate body having a first end and a second end opposite the first end. The elongate body includes a transitional section between the first end and the second end. The first end terminates in a tapered point. The elongate body has a first section disposed between the first end and the transitional section. The first section includes a first effective cross-sectional area based on a first effective outer diameter. The elongate body has a second section disposed between the second end and the transitional section. The second section has a second effective cross-sectional area that is greater than the first effective cross-sectional area. The second effective cross-sectional area is defined by a second effective outer diameter. The elongate body has a first channel formed along a first side of the second section. The first channel extends from the second end toward the transitional section. The elongate body has a second channel formed along a second side of the second section. The second channel extends from the second end toward the transitional section. The second side is opposite the first side. The fid includes an aperture passing from the first side of the second section through to the second side. The aperture is disposed in both the first channel and the second channel.

In accordance with aspects of the present invention, the second effective cross-sectional area can be about 2 to 4 times greater than the first effective cross-sectional area. The second effective cross-sectional area can be sized and dimensioned in such a way that a segment of rope, determined by the particular form of splicing required, has a cross-sectional area that is less than about half of the second effective cross-sectional area.

In accordance with aspects of the present invention, the first channel and the second channel can be sized and dimensioned to receive a segment of rope, determined by the particular form of splicing required, in such a way that the segment of rope has a diameter that is about equal to or less than a depth of the first channel. The segment of rope can have a diameter that is about equal to or less than a depth of the second channel.

In accordance with aspects of the present invention, the elongate body can be made from a solid material. Alternatively, the elongate body can be made from a metal, wood, plastic, composite, or any combination thereof.

In accordance with aspects of the present invention, the aperture can have an elongate shape.

In accordance with aspects of the present invention, the fid can include a second aperture passing from the first side of the elongate body through to the second side. The second aperture, disposed proximal with the first end, can provide an insertion point for a tool in such a way that when the tool is inserted in the second aperture, a temporary handle is formed between the tool and the second aperture allowing a user to pull the fid through a rope.

In accordance with aspects of the present invention, the elongate body can be monolithic.

In accordance with aspects of the present invention, the first channel can extend through the second end and the second channel can extend through the second end.

In accordance with aspects of the present invention, the fid includes a rim portion surrounding the aperture to provide an edge configured to bite into a segment of rope and hold the segment of rope in place. In a further aspect, the rim portion can be a rounded edge section.

In accordance with an embodiment of the present invention, a method of using a fid for splicing includes providing a fid having a first channel formed along a first side of the fid and a second channel formed along a second side of the fid opposite from the first side. The fid includes an aperture passing completely therethrough and disposed in both the first channel and the second channel. A segment of rope is placed into the first channel. This segment of rope is determined by the particular form of splicing being implemented. An end of the segment of rope is threaded through the aperture to form a threaded segment of rope. The threaded segment of rope is folded in proximity of the aperture to form a folded segment of rope, thus enabling placement of the threaded segment of rope into the second channel. The threaded segment of rope is placed into the second channel.

In accordance with aspects of the present invention, the first channel and the second channel can be formed on a section of the fid having an effective cross-sectional area sized and dimensioned in such a way that the segment of rope has a cross-sectional area that is less than about half of the effective cross-sectional area.

In accordance with aspects of the present invention, the segment of rope can be a core portion of the rope. Using a fid, a section of the core portion of the rope is threaded through a section of a cover portion of the rope. The section of the core portion includes the segment of rope placed into the first channel, the threaded segment of rope, and the segment of rope placed into the second channel.

In accordance with aspects of the present invention, the segment of rope can be a cover portion of the rope. Using the fid, a section of the cover portion of the rope is threaded through a section of a core portion of the rope. The section of the cover portion includes the segment of rope placed into the first channel, the threaded segment of rope, and the segment of rope placed into the second channel.

In accordance with aspects of the present invention, the segment of rope can be a braided rope. Using the fid, a first section of the braided rope is threaded through a second section of the braided rope. The first section of the braided rope includes the segment of rope placed into the first channel, the threaded segment of rope, and the segment of rope placed into the second channel.

In accordance with aspects of the present invention, using the fid, a first section of rope can be threaded through a second section of rope. The first section of rope includes the segment of rope placed into the first channel, the threaded and folded segment of rope, and the segment of rope placed into the second channel. A frictional force experienced by the first section of rope placed into the first channel can be about equal to a frictional force experienced by the first section of rope placed into the second channel as the fid is pushed through the second section of rope.

BRIEF DESCRIPTION OF THE FIGURES

These and other characteristics of the present invention will be more fully understood by reference to the following detailed description in conjunction with the attached drawings, in which.

DETAILED DESCRIPTION

Figure 1:
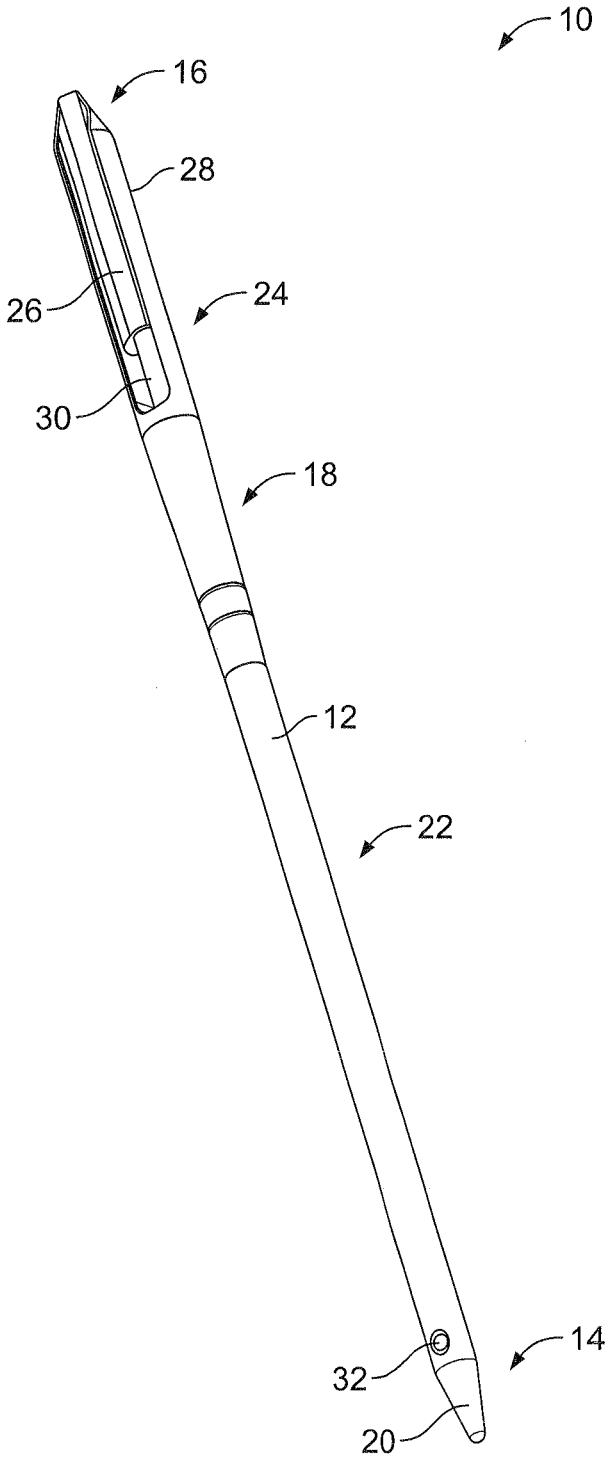
FIG. 1 is a perspective view of a fid, according to an embodiment of the present invention.

An illustrative embodiment of the present invention relates to a fid having a first channel formed along one side of the fid and a second channel formed along an opposite side of the fid. An aperture passes completely through both the first channel and the second channel. This configuration enables the fid to grasp or clutch a segment of rope during the splicing process and hold it in place without the need for taping or additional fastening of the rope. More particularly, the segment of rope can be arranged within the first channel, second channel, and aperture, while substantially equal friction forces are experienced by the segment of rope in each channel, thereby holding the segment of rope in place as the fid is pushed through a second segment of rope. The segment of rope used is determined by the particular form of splicing that is implemented.

FIGS. 1 through 5, wherein like parts are designated by like reference numerals throughout, illustrate an example embodiment of a fid apparatus according to the present invention. Although the present invention will be described with reference to the example embodiment illustrated in the figures, it should be understood that many alternative forms can embody the present invention. One of skill in the art will additionally appreciate different ways to alter the parameters of the embodiments disclosed, such as the size, shape, or type of elements or materials, in a manner still in keeping with the spirit and scope of the present invention.

Figure 2A:
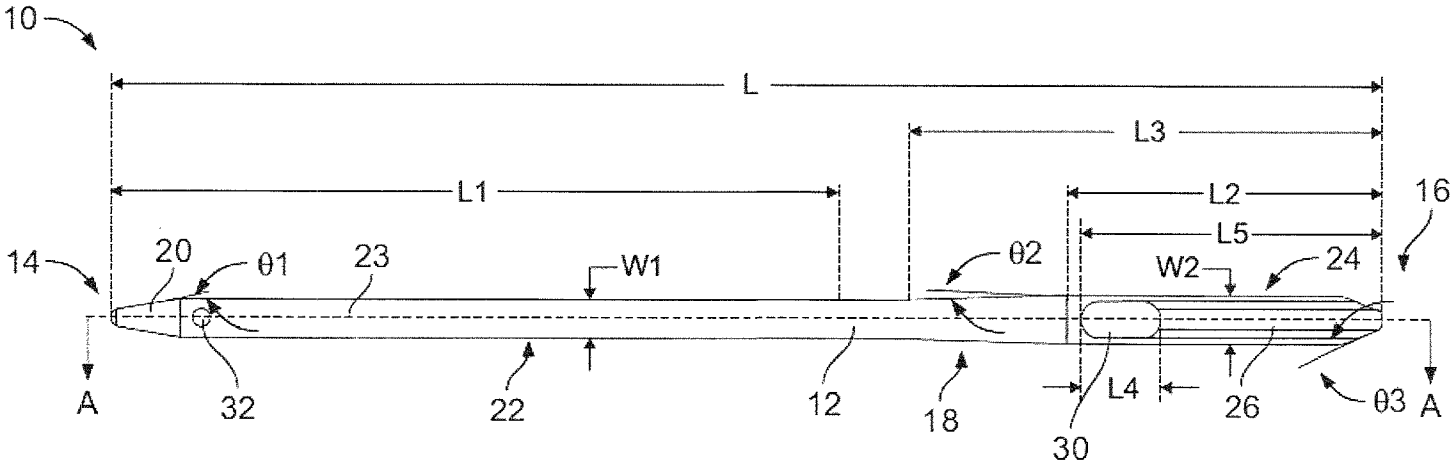
FIG. 2A is a top view of a fid, according to one aspect of the present invention.
Figure 2B:
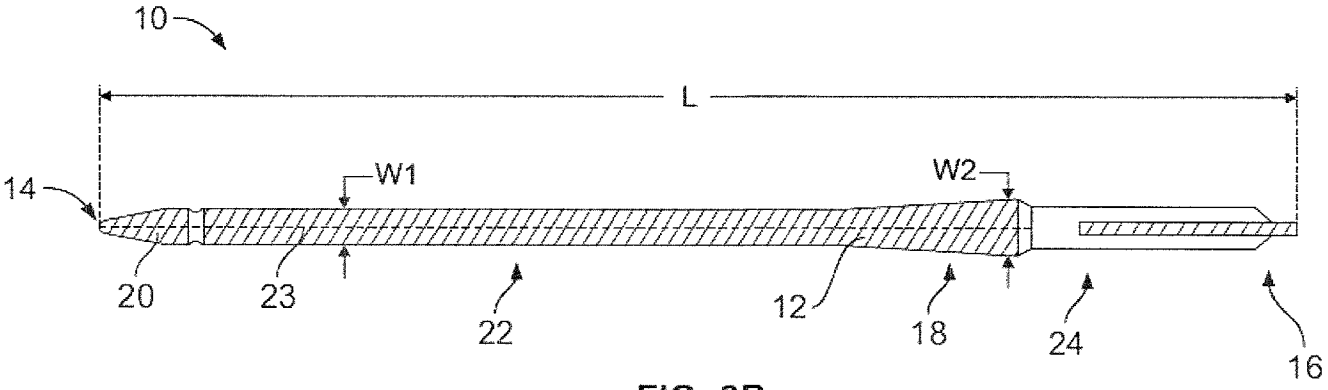
FIG. 2B is a side cross-sectional view along section A-A of the fid in FIG. 2A, according to one aspect of the present invention.
Figure 3:
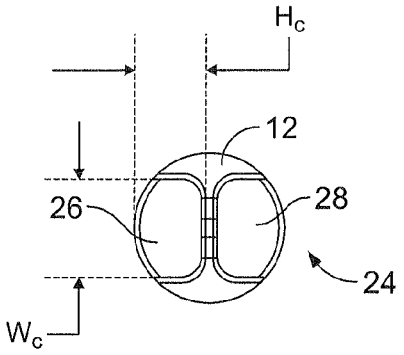
FIG. 3 is a zoomed-in cross-sectional view of the first and second channels of the fid, according to one aspect of the present invention.

Referring now to FIGS. 1-3, a fid 10 for splicing is depicted according to an example embodiment of the present invention. FIG. 2A is a top view of the fid 10 in FIG. 1. FIG. 2B is a side cross-sectional view along section A-A of the fid 10 in FIG. 2A.

The fid 10 includes an elongate body 12 having a first end 14 and a second end 16 opposite the first end 14. In one example, the elongate body 12 is made from a solid material. For example, the elongate body 12 can be made from a metal material, wood material, plastic material, composite material, or any combination of these materials. In another example, the elongate body 12 is monolithic. The elongate body 12 has a length L as shown in FIGS. 2A-2B. For example, in certain illustrative implementations where the fid 10 is sized and dimensioned for splicing conventional ropes, L can be about 5 and ½ inches to about 68 and ¼ inches. However, one of skill in the art will appreciate other dimensional ranges for length L that may be more appropriate for implementation with a particular rope, and all such dimensional ranges are considered to fall within the scope of the present invention.

The elongate body 12 includes a transitional section 18 between the first end 14 and the second end 16. The transitional section 18 has a width that changes or tapers toward the first end 14 providing a transition between a first section 22 having width W1 and a second section 24 having a different width W2. The transitional section 18 tapers at an angle θ2 as shown in FIG. 2A. For example, in certain illustrative implementations where the fid 10 is sized and dimensioned for splicing conventional ropes, θ2 can be about 1 degree to about 3 degrees. However, one of skill in the art will appreciate other dimensional ranges for angle θ2 that may be more appropriate for implementation with a particular rope, and all such dimensional ranges are considered to fall within the scope of the present invention.

The phrase "effective outer diameter" as utilized throughout the present description is intended to be utilized consistent with its ordinary and known usage. Specifically, the effective outer diameter is the measurement of the diameter of an imaginary flexible tube wrapped tightly around the object and not folded upon itself. For example, a tube wrapped around the letter "C" would follow the curvature of the letter on the top, bottom, and left sides, and then extend directly across the gap on the right side. The dimension of the diameter of the tube is the effective outer diameter.

Correspondingly, the phrase "effective cross-sectional area" as utilized throughout the present description is intended to be utilized consistent with its ordinary and known usage. Specifically, the effective cross-sectional area is the measurement of the total cross-sectional area that results from an imaginary flexible tube wrapped tightly around the object and not folded upon itself. For example, a tube wrapped around the letter "C" would follow the curvature of the letter on the top, bottom, and left sides, and then extend directly across the gap on the right side. The dimension of the cross-sectional area of the tube that results is the effective cross-sectional area.

The elongate body 12 includes the first section 22 disposed between the first end 14 and the transitional section 18. The first section 22 includes a first effective cross-sectional area based on the first effective outer diameter or width W1 as shown in FIGS. 2A-2B. For example, in certain illustrative implementations where the fid 10 is sized and dimensioned for splicing conventional ropes, W1 can be about 5/32 inches to about 1 and 21/32 inches. However, one of skill in the art will appreciate other dimensional ranges for the outer diameter or width W1 that may be more appropriate for implementation with a particular rope, and all such dimensional ranges are considered to fall within the scope of the present invention. The first effective cross-sectional area of the first section 22 is a sliced section of the first section 22 orthogonal to the central axis 23 of the elongate body 12.

The first section 22 includes a tapered point 20 that terminates at the first end 14. The tapered point 20 has an angle θ1 as shown in FIG. 2A. Also, the first section 22 has a length L1 as shown in FIG. 2A. For example, in certain illustrative implementations where the fid 10 is sized and dimensioned for splicing conventional ropes, L1 can be about 3 and ⅛ inches to about 39 inches. However, one of skill in the art will appreciate other dimensional ranges for length L1 that may be more appropriate for implementation with a particular rope, and all such dimensional ranges are considered to fall within the scope of the present invention.

The elongate body 12 includes the second section 24 disposed between the second end 16 and the transitional section 18. The second section 24 includes a second effective cross-sectional area defined by a second effective outer diameter or width W2 as shown in FIGS. 2A-2B. For example, in certain illustrative implementations where the fid 10 is sized and dimensioned for splicing conventional ropes, W2 can be about 7/32 inches to about 2 and ½ inches. However, one of skill in the art will appreciate other dimensional ranges for the second effective outer diameter or width W2 that may be more appropriate for implementation with a particular rope, and all such dimensional ranges are considered to fall within the scope of the present invention. The second effective cross-sectional area of the second section 24 is a sliced section of the second section 24 orthogonal to the central axis 23 of the elongate body 12. FIG. 3 displays the second effective cross-sectional area of the second section 24 orthogonal to the central axis 23.

The second effective cross-sectional area is greater than the first effective cross-sectional area, as would be appreciated by those of skill in the art based on the relatively larger second effective outer diameter or width W2 relative to the first effective outer diameter or width W1 as described and shown. In one example, the second effective cross-sectional area is about 2 to 4 times greater than the first effective cross-sectional area. In another example, the second effective cross-sectional area is about 2.25 to 2.5 times greater than the first effective cross-sectional area. The second effective cross-sectional area is sized and dimensioned in such a way that a segment of rope 40, determined by the particular form of splicing required, has a cross-sectional area, that is less than about half of the second effective cross-sectional area as shown in FIG. 2B.

The elongate body 12 further includes a first channel 26 formed along one side of the second section 24. The first channel 26 extends from the second end 16 toward the transitional section 18. Also, the elongate body 12 has a second channel 28 formed along an opposite side, with respect to the first channel 26, of the second section 24. The second channel 28 extends from the second end 16 toward the transitional section 18. In one example, as shown in FIGS. 1 and 2A, the first channel 26 extends through the second end 16 and the second channel 28 extends through the second end 16. As shown in FIG. 2A, the end of the second section 24, at the second end 16, has an angle of θ3. The purpose of the first and second channels 26, 28 extending through the end of the second end 16 is to enable a rope being spliced to lay flat within, and be fully enveloped by, each channel 26, 28 as described herein. If the channels 26, 28 did not extend through the second end 16, then the rope would have to come up and out of the channels 26, 28 at the second end 16, thereby drastically reducing the effectiveness of the inventive fid design.

The second section 24 has an aperture 30 passing completely through the second section 24 from one side to another. The aperture 30 is disposed in a portion of both the first channel 26 and the second channel 28. In one example, the aperture 30 has an elongate shape. As shown in FIG. 2A, the aperture 30 has a length L4 which can be varied from fid to fid, sized and dimensioned as would be understood by those of skill in the art. In another example, the fid 10 includes a rim portion surrounding the aperture 30 that provides an edge configured to bite into a segment of rope 40 that is inserted into the aperture 30 and hold the segment of rope 40 in place. In one example, the rim portion is a rounded edge section or the like that is configured to grasp a segment of rope 40 and frictionally hold the segment of rope 40 in place during splicing, hindering the rope from sliding.

The first section 22 of the fid 10 includes a second aperture 32 disposed through the first section 22 near the tapered point 20. This second aperture 32 provides an insertion point for a tool so that when the tool is inserted into the second aperture 32 a temporary handle is formed between the tool and the second aperture 32. In one example, this allows a user to be able to pull the fid 10 through a thicker segment of rope 40 during the splicing process. For example, a nail, shaft, stiff wire, or another rope can be the tool inserted into the second aperture 32 to create the temporary handle for assisting in pulling fid 10 through a difficult segment of rope 40.

In FIG. 2A, the elongate body 12 has lengths L2, L3, and L5 measured from particular points on the second section 24 and transitional section 18 of the elongate body 12 to the second end 16. These lengths L2, L3, and L5 can vary depending on the fid's particular use. For example, in certain illustrative implementations where the fid 10 is sized and dimensioned for splicing conventional ropes, L2 can be about 1 and 3/8 inches to about 15 and 1/16 inches, L3 can be about 2 and 1/16 inches to about 17 and 1/16 inches, and L5 can be about 1 and 5/16 inches to about 15 inches. However, one of skill in the art will appreciate other dimensional ranges for lengths L2, L3, and L5 that may be more appropriate for implementation with a particular rope, and all such dimensional ranges are considered to fall within the scope of the present invention.

FIG. 3 depicts a close-up cross-sectional view of the first channel 26 and the second channel 28 within the second section 24. The first channel 26 is sized about equal to the second channel 28 because a rope being spliced has the same cross-sectional area for both portions that are placed in the channels 26, 28. The channels 26, 28 have a channel width $W_C$ and channel depth or height $H_C$, which are sized and dimensioned to receive the particular rope being spliced, as would be appreciated by one of skill in the art. For example, in certain illustrative implementations where the fid 10 is sized and dimensioned for splicing conventional ropes, $W_C$ can be about 9/64 inches to about 1 and 5/8 inches and $H_C$ is about 3/32 inches to about 1 and 1/8 inches. However, one of skill in the art will appreciate other dimensional ranges for channel width $W_C$ and channel depth or height $H_C$ that may be more appropriate for implementation with a particular rope, and all such dimensional ranges are considered to fall within the scope of the present invention. In one example, the first channel 26 and the second channel 28 are sized and dimensioned to receive a segment of rope 40, determined by the particular form of splicing required, in such a way that the segment of rope 40 has a diameter that is about equal to or less than a depth $H_C$ of the first channel 26 or the depth $H_C$ of the second channel 28.

Figure 4A:
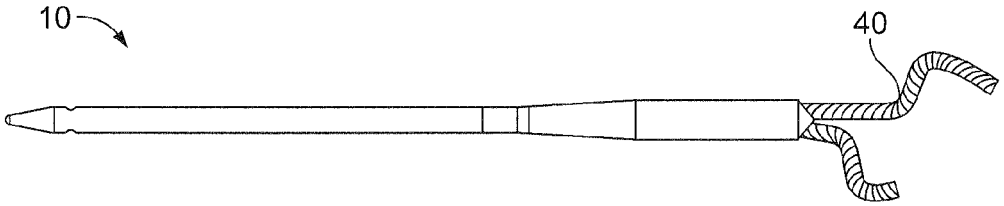
FIGS. 4A-4C are perspective views of the fid of FIG. 1 in use clutching a segment of rope, according to aspects of the present invention.
Figure 4B:
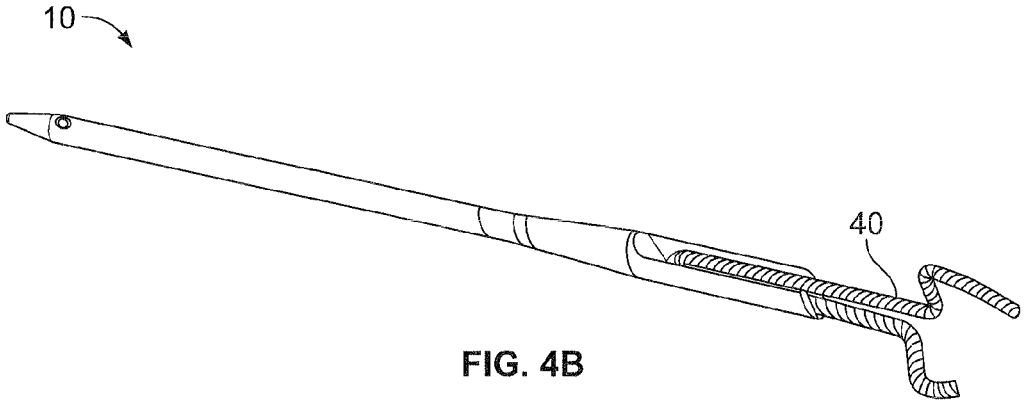
Figure 4C:
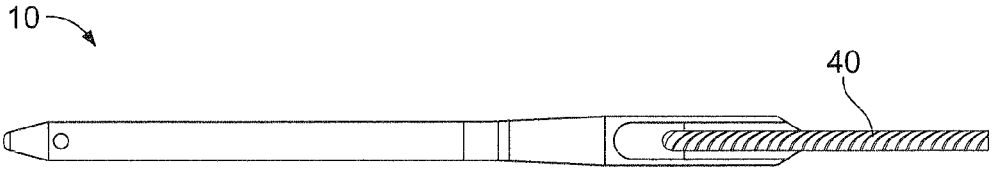

FIGS. 4A-4C depict a fid 10 in use with a segment of rope 40. In particular, the fid 10 is able to clutch or grasp the segment of rope 40 when the segment of rope 40 is threaded through the aperture 30, folded, and positioned in the first and second channels 26, 28.

Figure 5:
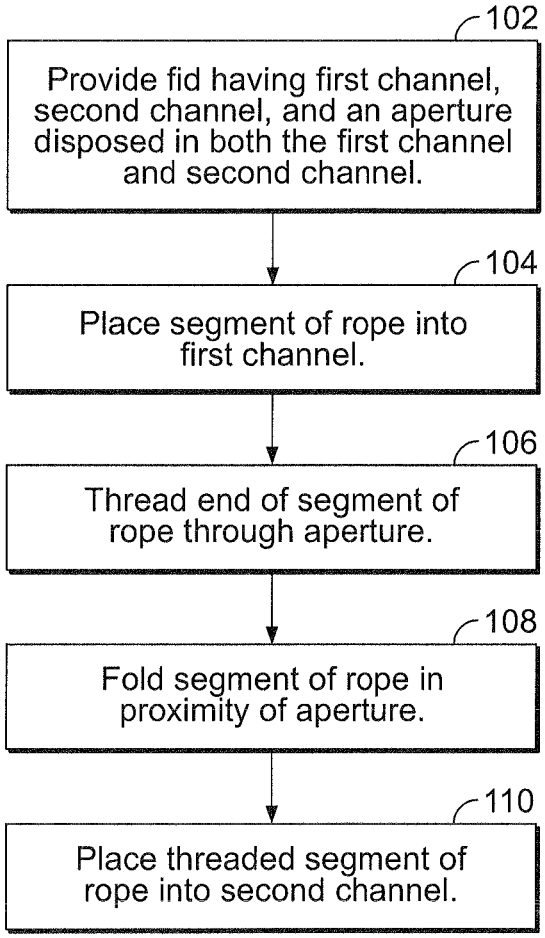
FIG. 5 is a flow chart illustrating a method of using a fid, according to an embodiment of the present invention.

FIG. 5 illustrates an example of steps required to use the fid 10 as shown in FIGS. 4A-4C. In step 102, the fid 10 is provided having the first channel 26, second channel 28, and the aperture 30 disposed in both the first channel 26 and second channel 28. The first channel 26 is formed along a first side of the fid 10 and the second channel 28 is formed along a second side of the fid 10 opposite from the first side. The aperture 30 passes completely through both the first channel 26 and the second channel 28. The segment of rope 40 is placed into the first channel 26 (step 104). This segment of rope 40 is determined by the particular form of splicing being implemented. For example, the form of splicing can be an eye splice, long splice, or back splice. In step 106, an end of the segment of rope 40 is threaded through the aperture 30. The segment of rope 40 is folded near (or in proximity of) the aperture 30 to enable placement of the threaded segment of rope 40 into the second channel 28 (step 108). In step 110, the threaded segment of rope 40 is placed into the second channel 28.

In one example, a first section of rope is threaded through a second section of rope. The first section of rope includes the segment of rope placed into the first channel 26, the threaded segment of rope in the aperture 30, and the segment of rope placed into the second channel 28. A frictional force experienced by the first section of rope in the first channel 26 is about equal to a frictional force experienced by the segment of rope placed in the second channel 28 as the fid 10 is pushed through the second section of rope. Said differently, when the segment of rope 40 is placed in the fid 10 and the fid 10 is being pushed/pulled through another segment of rope for example, any force or friction that can pull the segment of rope 40 out of the fid 10 is experienced equally between the segment of rope in the first channel 26 and the segment of rope in the second channel 28 such that it effectively cancels out any tendency for the segment of rope 40 to pull out of the fid 10.

The use of the fid 10 in accordance with the representations of FIGS. 1-5 can be with any type of rope splicing process. In particular, the splicing process can be an eye splice, long splice, rope-to-chain splice, end-for-end splice, back splice, or the like. One of skill in the art would appreciate the variety of other splicing processes that may be carried out with the fid 10. Also, the segment of rope 40 can be a 3-strand rope (class I), 8-strand rope (class I and H), 8×3-strand rope (class II), 12-strand rope (class I and II, HMPE class II, and Saturn-12 class II), 16-strand rope (class I), double braid rope (class I, II, tubo-37 class II, and TS-II class II), or the like. Again, the ropes listed are merely illustrative, and those of skill in the art will appreciate a number of additional rope types that may be spliced using the inventive fid as described herein. Accordingly, the present invention is in no way limited to use with the particular ropes described herein.

In accordance with one eye splice process example, the segment of rope 40 is a core portion of the rope. Using the fid 10, a section of the core portion of the rope is threaded through a section of a cover portion of the rope. The section of the core portion includes the segment of rope placed into the first channel 26, the threaded segment of rope in the aperture 30, and the segment of rope placed into the second channel 28. In another eye splice process example, the segment of rope 40 is a cover portion of the rope. Using the fid 10, a section of the cover portion of the rope is threaded through a section of a core portion of the rope. The section of the cover portion includes the segment of rope placed into the first channel 26, the threaded segment of rope in the aperture 30, and the segment of rope placed into the second channel 28.

In another example, the segment of rope 40 is a braided rope. Using the fid 10, a first section of the braided rope is threaded through a second section of the braided rope. The first section of the braided rope includes the segment of rope placed into the first channel 26, the threaded segment of rope in the aperture 30, and the segment of rope placed into the second channel 28. Many additional splicing processes may be implemented in conjunction with the present invention.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification embodiments have been described in a way which enables a clear and concise specification to be written, but it is intended and will be appreciated that embodiments may be variously combined or separated without parting from the invention. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. A fid for splicing, the fid comprising:

an elongate body having a first end and a second end opposite the first end, with a transitional section of the elongate body therebetween, the first end terminating in a tapered point;

a first section of the elongate body disposed between the first end and the transitional section, the first section having a first effective cross-sectional area based on a first effective outer diameter;

a second section of the elongate body disposed between the second end and the transitional section, the second section having a second effective cross-sectional area that is greater than the first effective cross-sectional area, the second effective cross-sectional area defined by a second effective outer diameter;

a first channel formed along a first side of the second section of the elongate body and extending from the second end toward the transitional section;

a second channel formed along a second side of the second section of the elongate body and extending from the second end toward the transitional section, the second side being opposite the first side;

an aperture passing from the first side of the second section of the elongate body through to the second side, the aperture disposed in both the first channel and the second channel; and a second aperture passing from the first side of the elongate body through to the second side, wherein the second aperture, disposed proximal with the first end, provides an insertion point for a tool in such a way that when the tool is inserted in the second aperture a temporary handle is formed between the tool and the second aperture, allowing a user to pull the fid through a rope.

2. The fid of claim 1, wherein the second effective cross-sectional area is about 2 to 4 times greater than the first effective cross-sectional area.

3. The fid of claim 1, wherein the first channel and the second channel are sized and dimensioned to receive a segment of rope, determined by the particular form of splicing required, in such a way that the segment of rope has a diameter that is about equal to or less than a depth of the first channel and the segment of rope has a diameter that is about equal to or less than a depth of the second channel.

4. The fid of claim 1, wherein the second effective cross-sectional area is sized and dimensioned in such a way that a segment of rope, determined by the particular form of splicing required, has a cross-sectional area that is less than about half of the second effective cross-sectional area.

5. The fid of claim 1, wherein the elongate body is made from a solid material.

6. The fid of claim 1, wherein the elongate body is made from a metal, wood, plastic, composite, or any combination thereof.

7. The fid of claim 1, wherein the aperture has an elongates shape.

8. The fid of claim 1, wherein the elongate body is monolithic.

9. The fid of claim 1, wherein the first channel extends through the second end and the second channel extends through the second end.

10. The fid of claim 1, further comprising a rim portion surrounding the aperture to provide an edge configured to bite into a segment of rope and hold the segment of rope in place.

11. The fid of claim 10, wherein the rim portion is a rounded edge section.

12. A method of using a fid for splicing comprising:

the fid having a first channel formed along a first side of the fid and a second channel formed along a second side of the fid opposite from the first side, wherein the fid includes an aperture passing completely therethrough and disposed in both the first channel and the second channel;

placing a segment of rope into the first channel, wherein the segment of rope is determined by the particular form of splicing being implemented;

threading an end of the segment of rope through the aperture to form a threaded segment of rope;

folding the segment of rope in proximity of the aperture to form a folded segment of rope, thus enabling placement of the threaded segment of rope into the second channel;

placing the threaded segment of rope into the second channel;

and splicing.

13. The method of claim 12, wherein the fid further comprises:

an elongate body having a first end and a second end opposite the first end, with a transitional section of the elongate body therebetween, the first end terminating in a tapered point;

a first section of the elongate body disposed between the first end and the transitional section, the first section having a first effective cross-sectional area based on a first effective outer diameter; and a second section of the elongate body disposed between the second end and the transitional section, the second section having a second effective cross-sectional area that is greater than the first effective cross-sectional area, the second effective cross-sectional area defined by a second effective outer diameter;

wherein the first channel is formed along a first side of the second section of the elongate body and extends from the second end toward the transitional section;

wherein the second channel is formed along a second side of the second section of the elongate body and extends from the second end toward the transitional section, the second side being opposite the first side; and wherein the aperture passes from the first side of the second section of the elongate body through to the second side of the elongate body.

14. The method of claim 13, further comprising the segment of rope placed into the first channel extending through the second end and the segment of rope placed into the second channel extending through the second end.

15. The method of claim 12, wherein the first channel and the second channel are formed on a section of the fid having an effective cross-sectional area sized and dimensioned in such a way that the segment of rope has a cross-sectional area that is less than about half of the effective cross-sectional area.

16. The method of claim 12, further comprising utilizing a core portion of the rope to form the segment of rope.

17. The method of claim 16, further comprising threading, using the fid, a section of the core portion of the rope through a section of a cover portion of the rope, wherein the section of the core portion comprises the segment of rope placed into the first channel, the threaded segment of rope, and the segment of rope placed into the second channel.

18. The method of claim 12, wherein the segment of rope is a cover portion of the rope.

19. The method of claim 18, further comprising threading, using the fid, a section of the cover portion of the rope through a section of a core portion of the rope, wherein the section of the cover portion comprises the segment of rope placed into the first channel, the threaded segment of rope, and the segment of rope placed into the second channel.

20. The method of claim 12, wherein the segment of rope is a braided rope.

21. The method of claim 20, further comprising threading, using the fid, a first section of the braided rope through a second section of the braided rope, wherein the first section of the braided rope comprises the segment of rope placed into the first channel, the threaded segment of rope, and the segment of rope placed into the second channel.

22. The method of claim 12, further comprising, using the fid, threading a first section of rope through a second section of rope, wherein the first section of rope comprises the segment of rope placed into the first channel, the threaded segment of rope, and the segment of rope placed into the second channel.

23. The method of claim 22, wherein a frictional force experienced by the first section of rope placed into the first channel is about equal to a frictional force experienced by the first section of rope placed into the second channel as the fid is pushed through the second section of rope in such a way that the first and second sections of rope do not pull out of the fid.

* * * * *